US011201437B2

(12) United States Patent
Luo et al.

(10) Patent No.: US 11,201,437 B2
(45) Date of Patent: Dec. 14, 2021

(54) INSULATING CONNECTOR FOR AN ELECTRICAL CABLE

(71) Applicant: Tyco Electronics (Shanghai) Co. Ltd., Shanghai (CN)

(72) Inventors: Ji Luo, Dongguan (CN); Zhigang Song, Shanghai (CN); Jiahui Chen, Shanghai (CN); Songhua Liu, Dongguan (CN); Qingquan Wan, Dongguan (CN); Haibo Zhang, Shanghai (CN); Bing Hsu, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/743,569

(22) Filed: Jan. 15, 2020

(65) Prior Publication Data

US 2020/0227867 A1 Jul. 16, 2020

(30) Foreign Application Priority Data

Jan. 15, 2019 (CN) ..... 201910037802.2

(51) Int. Cl.

| | |
|---|---|
| ***H01R 13/6592*** | (2011.01) |
| ***H01R 4/36*** | (2006.01) |
| ***H01R 13/405*** | (2006.01) |
| ***H01R 13/512*** | (2006.01) |
| ***H01R 13/52*** | (2006.01) |
| ***H01R 13/64*** | (2006.01) |

(52) U.S. Cl.

CPC ..... *H01R 13/6592* (2013.01); *H01R 4/36* (2013.01); *H01R 13/405* (2013.01); *H01R 13/512* (2013.01); *H01R 13/5202* (2013.01); *H01R 13/5205* (2013.01); *H01R 13/64* (2013.01)

(58) Field of Classification Search

None

See application file for complete search history.

(56) References Cited

U.S. PATENT DOCUMENTS

| | | | | | |
|---|---|---|---|---|---|
| 3,646,496 | A * | 2/1972 | Williams | H01R 13/6592 | 439/462 |
| 4,106,834 | A * | 8/1978 | Horowitz | H01R 13/533 | 439/142 |
| 4,307,926 | A * | 12/1981 | Smith | H01R 24/562 | 439/580 |
| 5,102,351 | A * | 4/1992 | Meshel | H01R 13/65912 | 439/607.01 |
| 5,386,486 | A * | 1/1995 | Fan | G02B 6/3807 | 385/59 |

(Continued)

*Primary Examiner* — Oscar C Jimenez

(74) *Attorney, Agent, or Firm* — Barley Snyder

(57) ABSTRACT

An electrical connector adapted to be electrically connected with a cable includes a fixing assembly, an insulation body, and a conductive terminal overmolded in the insulation body. The fixing assembly includes a receiving portion extending in an axial direction of the electrical connector. An end of the cable is inserted into the receiving portion from a first end of the receiving portion. The insulation body extends from a second end of the receiving portion. The conductive terminal includes a mounting portion mounted in the insulation body and a contact portion extending out of the insulation body. The mounting portion is electrically connected with a conductor of the cable by a bolt member.

20 Claims, 9 Drawing Sheets

(56) References Cited

U.S. PATENT DOCUMENTS

| | | | | |
|---|---|---|---|---|
| 7,727,021 | B2 * | 6/2010 | Haruna | H01R 9/037 439/607.5 |
| 2004/0082222 | A1 * | 4/2004 | Okamura | H01R 9/032 439/607.58 |
| 2006/0003629 | A1 * | 1/2006 | Murphy | H01R 24/40 439/578 |
| 2017/0250500 | A1 * | 8/2017 | Chen | H01R 13/5825 |
| 2019/0199031 | A1 * | 6/2019 | Surana | H01R 13/64 |
| 2020/0274284 | A1 * | 8/2020 | Fair | H01R 13/15 |

* cited by examiner

INSULATING CONNECTOR FOR AN ELECTRICAL CABLE

CROSS-REFERENCE TO RELATED APPLICATION

This application claims the benefit of the filing date under 35 U.S.C. § 119(a)-(d) of Chinese Patent Application No. 201910037802.2, filed on Jan. 15, 2019.

FIELD OF THE INVENTION

The present invention relates to an electrical connector and, more particularly, to an electrical connector for connecting a cable.

BACKGROUND

A circular electrical connector for a communication device, an instrument, a control device, or an electrical device typically comprises an insulation body, a conductive terminal held in the insulation body, a metal housing sleeved over the insulation body, and a cable electrically connected to the conductive terminal. A conductive wire of the cable may extend into the metal housing from one end thereof and is electrically connected with the conductive terminal in the metal housing.

In order to ensure electromagnetic shielding of the electrical connector, a plurality of parts of the cable are usually required to be shielded. Further, a connection structure of a conductor of the cable with the conductive terminal is complicated, which increases manufacturing process cost as well as a complexity of the wiring assembly process of the electrical connector.

SUMMARY

An electrical connector adapted to be electrically connected with a cable includes a fixing assembly, an insulation body, and a conductive terminal overmolded in the insulation body. The fixing assembly includes a receiving portion extending in an axial direction of the electrical connector. An end of the cable is inserted into the receiving portion from a first end of the receiving portion. The insulation body extends from a second end of the receiving portion.

The conductive terminal includes a mounting portion mounted in the insulation body and a contact portion extending out of the insulation body. The mounting portion is electrically connected with a conductor of the cable by a bolt member.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
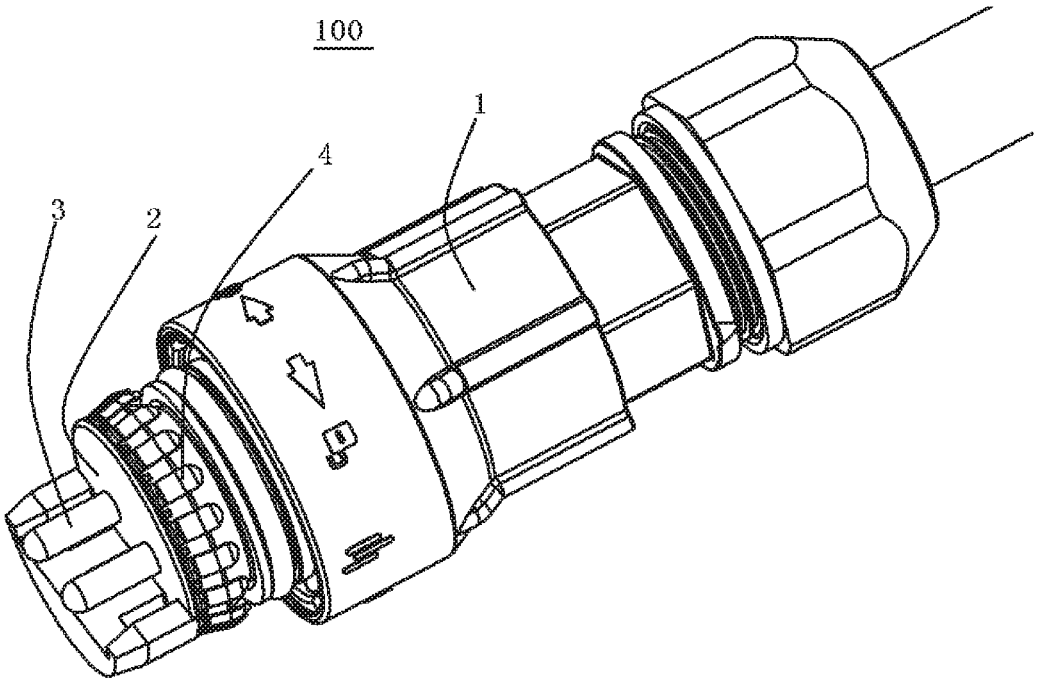
FIG. 1 is a perspective view of an electrical connector according to an embodiment.

The technical solution of the disclosure will be described hereinafter in further detail with reference to the following embodiments, taken in conjunction with the accompanying drawings. In the description, the same or similar reference numerals indicate the same or similar parts. The description of the embodiments of the disclosure hereinafter with reference to the accompanying drawings is intended to explain the general inventive concept of the disclosure and should not be construed as a limitation on the disclosure.

In addition, in the following detailed description, for the sake of explanation, numerous specific details are set forth in order to provide a thorough understanding of the disclosed embodiments. It will be apparent, however, that one or more embodiments may also be practiced without these specific details. In other instances, well-known structures and devices are illustrated schematically in order to simplify the drawing.

The electrical connector according to embodiments of the disclosure is applicable to an electrical device such as a communication device, a meter instrument, a control device, or the like to power the electrical device. The electrical connector may be constructed as a circular plug electrical connector and plugged into a receptacle electrical connector mounted on the electrical device.

An electrical connector 100 according to an embodiment, as shown in FIG. 1, adapted to be electrically connected with a cable 200 has a generally circular outer profile and comprises a fixing assembly 1, an insulation body 2, and a conductive terminal 3.

Figure 13:
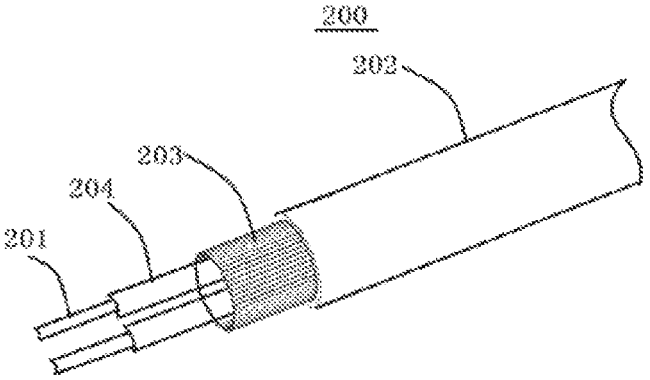
FIG. 13 is a perspective view of an end portion of a cable used in the electrical connector.

An end portion of the cable 200 is shown in FIG. 13. As shown in FIG. 13, the cable 200 has an outer sheath 202 into which a pair of conductive wires are received. A braided shielding wire 203 is disposed between the conductive wires and the outer sheath 202. Each of the wires comprises a conductor 201 and an inner sheath 204 wrapped around an external surface of the conductor 201. When the cable 200 is connected, the outer sheath 202 at one end of the cable 200 is partially removed to expose the braided shielding wire 203. The exposed braided shield wire 203 is then partially cut away to expose the two conductive wires. Thereafter, the inner sheath 204 of each of the wires is cut away to expose the conductor 201.

Figure 2:
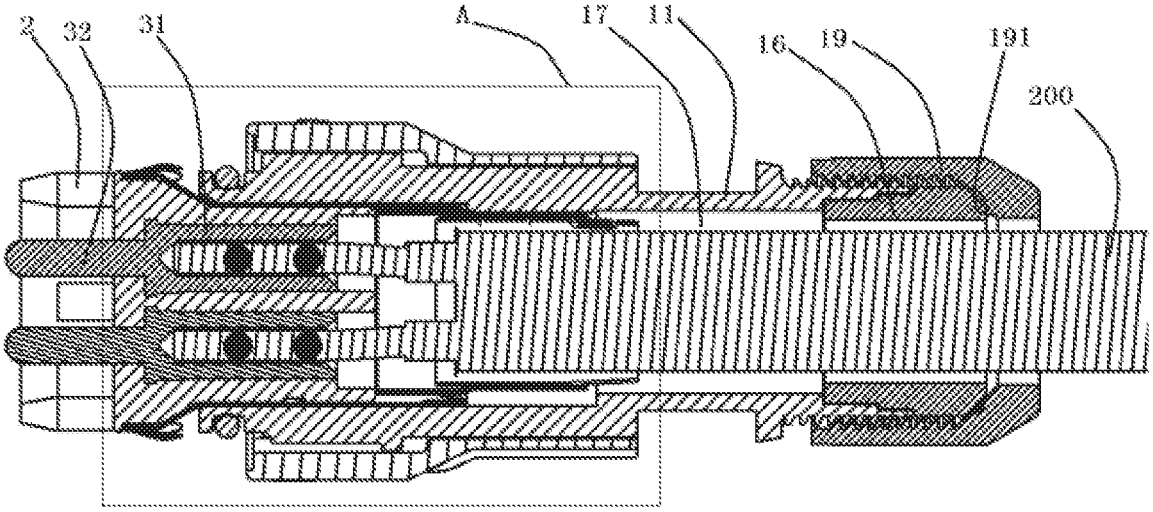
FIG. 2 is a sectional side view of the electrical connector of FIG. 1.
Figure 3:
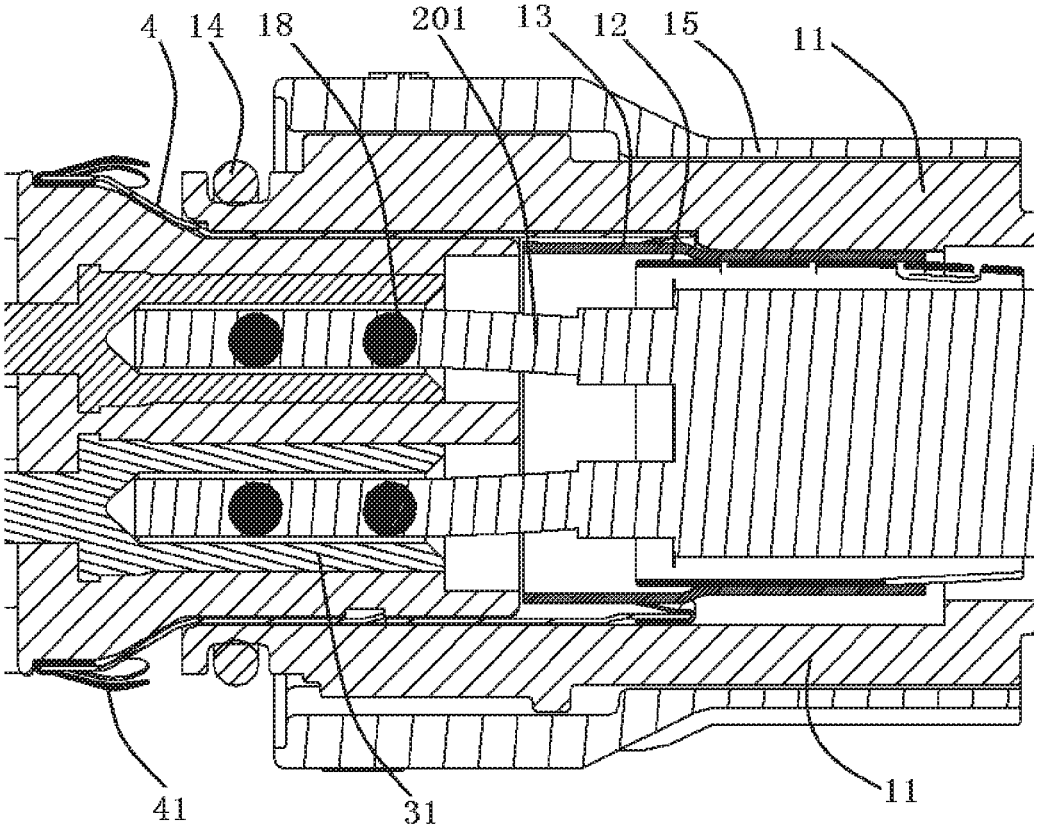
FIG. 3 is a detail view of a portion A of FIG. 2.
Figure 4:
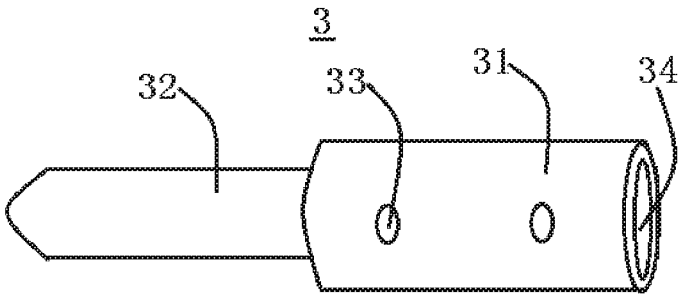
FIG. 4 is a perspective view of a conductive terminal according to an embodiment.

As shown in FIGS. 1-3, the fixing assembly 1 comprises a receiving portion 17 having a cylindrical space and extending in an axial direction of the electrical connector 100. An end of the cable 200 is inserted into the receiving portion 17 from a first end (the right end in FIG. 2) of the receiving portion 17. An insulation body 2 made of, for example, a plastic material extends out of a second end (the left end in FIG. 2) of the receiving portion 17. A conductive terminal 3 is fixed in the insulation body 2 through an overmolding process and comprises a mounting portion 31 mounted in the insulation body 2 and configured to be electrically connected with the conductor 201 of the cable 200 by a bolt member 18, and a contact portion 32 extending out of the insulation body 2 to be electrically connected with a mating terminal 301 of a mating connector 300, so that the electrical connector 100 is mated with the mating connector 300. During performing the overmolding process, the conductive terminal 3 is fixed in a mold, then a molten colloid is injected onto the conductive terminal 3. After the molten colloid is solidified, the conductive terminal 3 will be firmly fixed in the insulation body 2 formed by the molten colloid.

The electrical connector 100, in an embodiment, further comprises a first shielding sleeve 4, as shown in FIGS. 1-3. The first shielding sleeve 4 extends out of a second end of the receiving portion 17 and is sleeved over the insulation body 2 to electromagnetically shield the conductive terminals 3 mounted in the insulation body 2 and the conductor 201.

As shown in FIGS. 2-4 and 10, the mounting portions 31 of the conductive terminal 3 are each formed as a cylindrical structure axially extending, in which an receiving hole 34 extending axially is formed. A side wall of the cylindrical structure has at least one through hole 33 extending transversely, through which the bolt member 18 passes to abut against the conductor 201 of the cable 200 inserted into the cylindrical structure, so that the conductor 201 is positioned in the mounting portion 31. Because the conductive terminal 3 is fixed in the insulation body 2 through the overmolding process, the conductive terminal 3 may be firmly fixed in the insulation body 2, thereby avoiding the conductive terminal 3 from moving and/or rotating relative to the insulation body 2 during the mating of the electric connector 100 with the mating connector 300 through plugging. Further, the conductor 201 is held in the conductive terminal 3 by the bolt member 18, which simplifies an operation of connecting the conductor 201 and reduces the number of the parts. Further, it is possible to increase a conductive capacity of the conductor 201 and the conductive terminal 3, for example, it is possible to transmit a current of 50 (A) amperes or more.

In an exemplary embodiment of the disclosure, as shown in FIGS. 2, 3, 9, and 10, the insulation body 2 comprises an insertion portion 21 inserted into the receiving portion 17 at the second end of receiving portion 17, and an extension portion 22 integrally connected with the insertion portion 21 and located outside the receiving portion 17. The extension portion 22 is adapted to be inserted into a receiving sleeve of a mounting base as described in detail below. The first shielding sleeve 4 sleeved over the extension 22 may electromagnetically shield the conductive terminal 3 located outside the receiving portion 17.

In an exemplary embodiment, as shown in FIGS. 3, 5, 9, 10 and 11, the insulation body 2 includes a keyed portion 23 extending substantially parallel to the contact portion 32 of the conductive terminal 3 from the extension 22, and adapted to prevent the contact portion 32 of the conductive terminal 3 from being improperly inserted into the mating terminal 301 of the mating connector 300. The mounting base of a mating connector 300 has a receiving groove 302. When the keyed portion 23 is aligned with the receiving groove 302, the electrical connector 100 may be smoothly inserted into the mating connector 300 so that the two conductive terminals 3 of the electrical connector 100 may be properly electrically connected with the mating terminals of the mating connector 300. When the keyed portion 23 is not aligned with the receiving groove 302, the electrical connector 100 cannot be inserted into the mating connector 300 due to the protruding keyed portion 23, thereby avoiding an improper insertion of the electrical connector 100.

As shown in FIGS. 2, 3, 5-8, the fixing assembly 1 further comprises a cylindrical main cylinder 11 in which the receiving portion 17 is formed and including a first end (the right side in FIG. 2) and a second end (the left side in FIG. 2) opposite to each other. The main cylinder 11 comprises a first section 111, a second section 112, and a threaded section 113. The first section 111 has an outer diameter greater than that of the second section 112.

Figure 5:
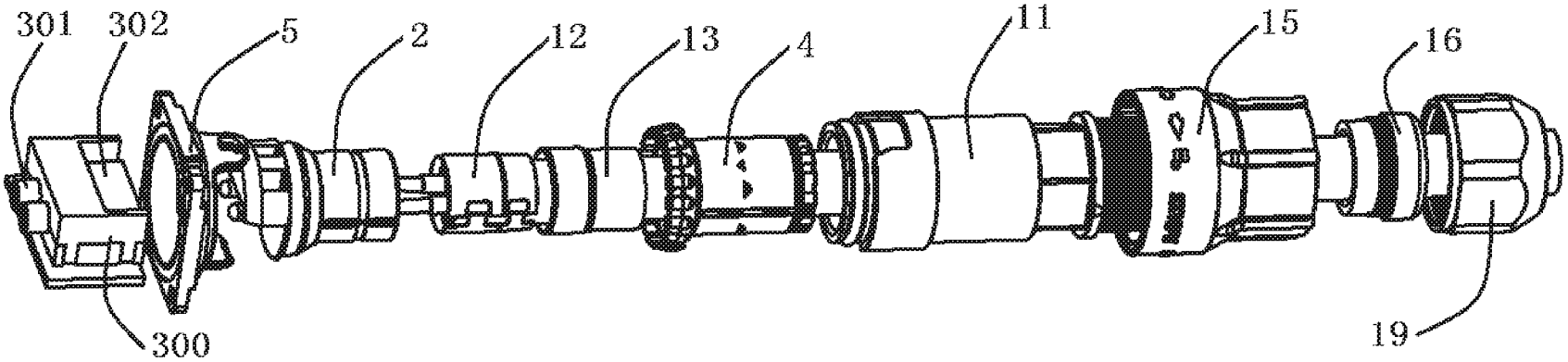
FIG. 5 is an exploded perspective view of the electrical connector of FIG. 1 with a mounting base and a mating connector.
Figure 6:
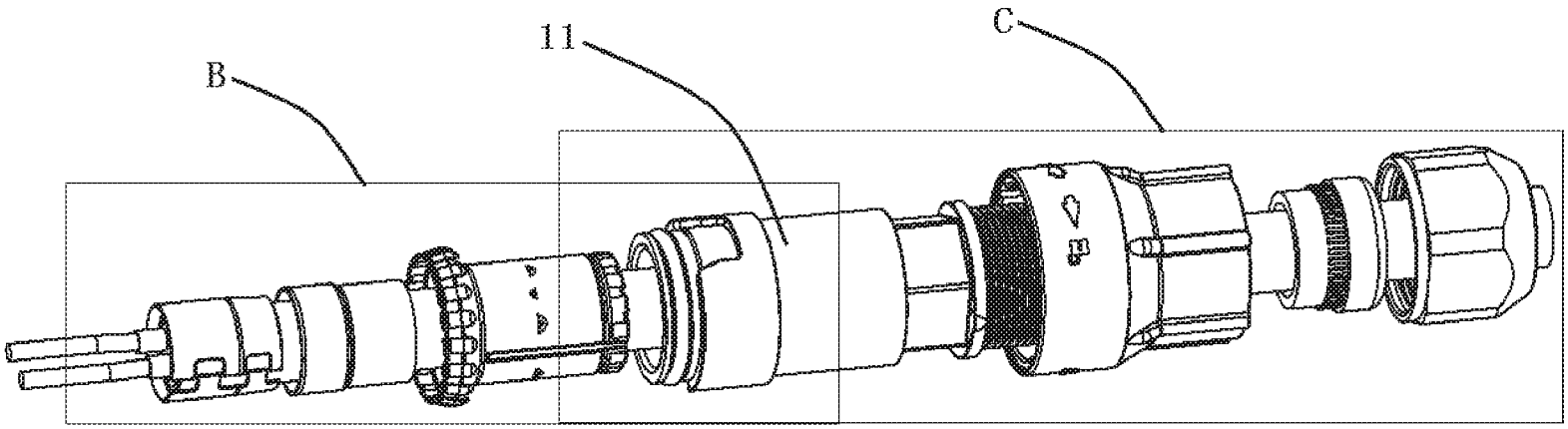
FIG. 6 is an exploded perspective view of the electrical connector of FIG. 1 without an insulation body and a first shielding sleeve.
Figure 7:
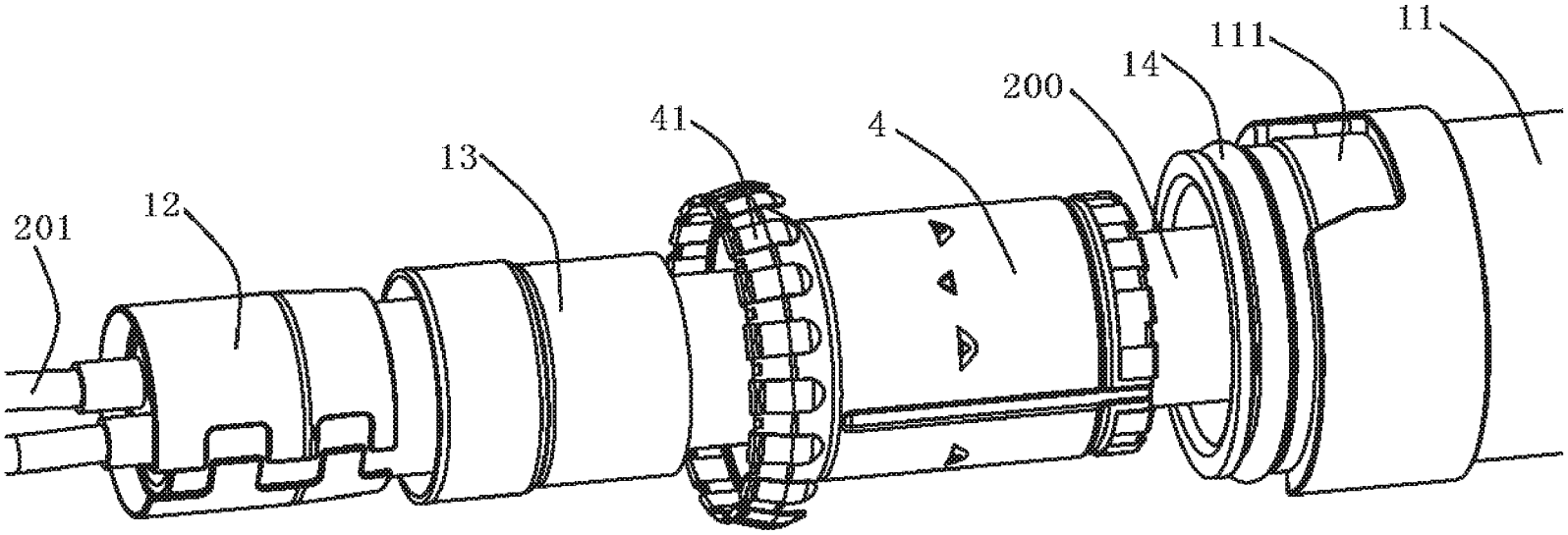
FIG. 7 is a detail view of a portion B of FIG. 6.

The fixing assembly 1, as shown in FIGS. 3, 5, and 7, further comprises an elastic sleeve 12 received in the main cylinder 11 and configured to be sleeved over a portion of the exposed braided shielding wire 203, which is folded back onto the outer sheath 202 of the cable 200, and to press the folded braided shielding wire 203 against the outer sheath 202 of the cable 200. In this way, the braided shield wire 203 of the cable 200 are reliably held on the outer sheath 202 of the cable 200 by the elastic sleeve 12, thereby improving connection efficiency of the braided shield wire 203 and electromagnetic shielding effect of the electric connector 100.

The fixing assembly 1, as shown in FIGS. 3, 5, and 7, further comprises a second shielding sleeve 13 sleeved over a portion of the exposed conductor of the cable 200 and a portion of the elastic sleeve 12. The first shielding sleeve 4 extends onto a portion of the second shielding sleeve 13 from the insulation body 2. In this way, the first shielding sleeve 4 and the second shielding sleeve 13 are continuously sleeved over a section, which is from a portion of the uncut outer sheath 202 of the cable 200 to a portion of the conductive terminal 3 which is fixed in the extension 22 of the insulation body 2, thereby improving the electromagnetic shielding effect of the electrical connector 100.

As shown in FIGS. 2, 3, and 5-8, the fixing assembly 1 further comprises a rotatable sleeve 15 rotatably disposed over the main cylinder 11. The rotatable sleeve 15 comprises a first portion 151 having a larger inner diameter and adapted to fit over the first section 114 of the main cylinder 11, and a second portion 152 having a smaller inner diameter and adapted to fit over the second section 112 of the main cylinder 11. The main cylinder 11 is formed with a step between the first section 111 and the second sections 112 to prevent the rotatable sleeve 15 from being separated from the first section 111 of the main cylinder 11.

Figure 11:
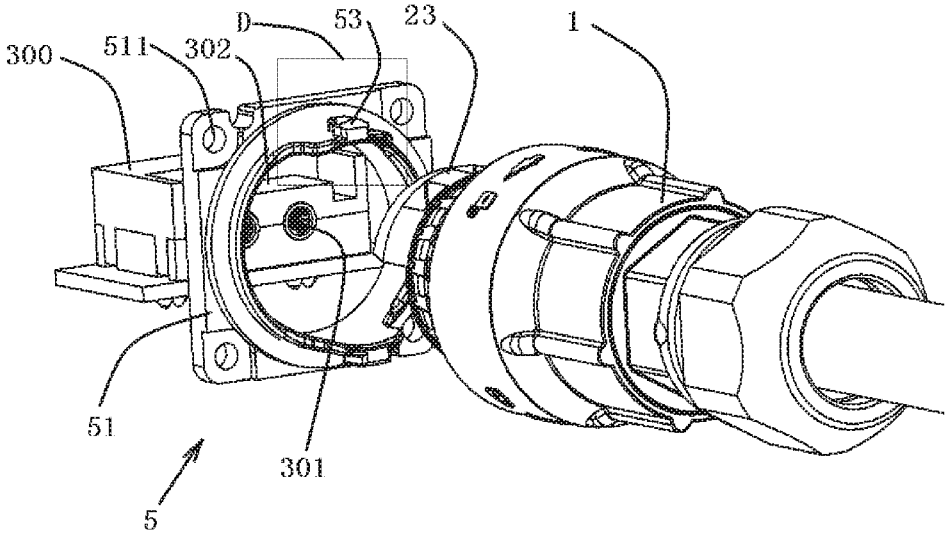
FIG. 11 is a perspective view of an electrical connector and a mating connector according to an embodiment.
Figure 12:
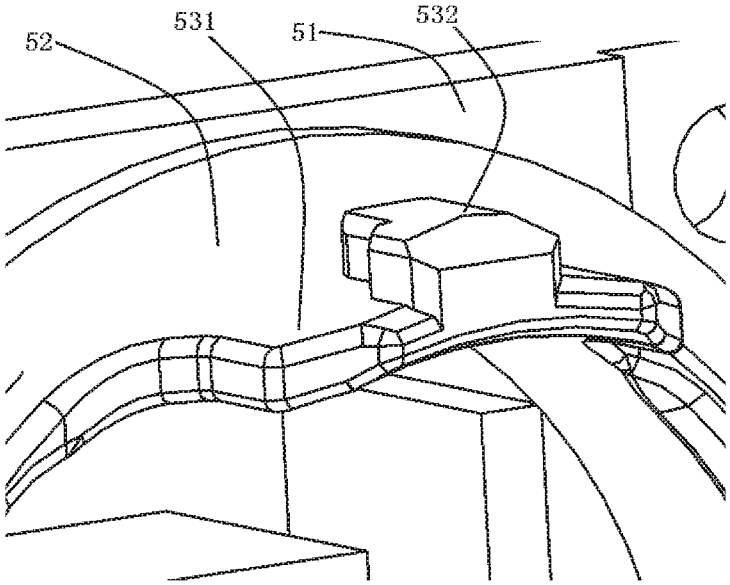
FIG. 12 is a detail view of a portion D of FIG. 11.

In an embodiment, as shown in FIGS. 5, 11 and 12, the electrical connector 100 further comprises a mounting base 5 mounted on the rotatable sleeve 15 to mount the electrical connector 100 on the mounting base 5. The mounting base 5 includes a flange 51 having a plurality of mounting holes 511, a receiving sleeve 52 in which the first shielding sleeve 4 extending out of the fixing assembly 1 and the extension 22 of the insulation body 2 are received, and a locking member 53 engaged with a mating locking member formed on the rotatable sleeve 15.

In an exemplary embodiment, as shown in FIG. 7, an end of the first shielding sleeve 4 extending out of the extension 22 of the insulation body 2 has a plurality of resilient pieces 41 which are folded onto the end the first shielding sleeve 4. In a case where the extension 22 of the insulation body 2 and the first shielding sleeve 4 are inserted into the receiving sleeve 52, the resilient pieces 41 are compressed against an inner wall of the receiving sleeve 52. Thus, it is possible to ensure the electrical connector 100 is stably mounted on the mounting base 5 and further provide the electromagnetic shielding effect.

The fixing assembly 1, as shown in FIG. 7, further comprises a sealing ring 14 mounted in a groove formed outside of the first end of the main cylinder 11. When the extension 22 of the insulation body 2 and the first shielding sleeve 4 are inserted into the receiving sleeve 52, the sealing ring 14 is compressed by the inner wall of the receiving sleeve 52, thereby providing water and moisture proof performance of the electrical connector 100.

In an exemplary embodiment, as shown in FIGS. 5, 7, 8, 11 and 12, the locking member 53 has an axial protrusion 531 axially protruding from the receiving sleeve 52, and a locking protrusion 532 radially protruding outwardly outside the axial protrusion 531. A receiving groove 111 radially recessed inwardly is formed outside of the first end of the main cylinder 11 to receive the axial protrusion 531 of the locking member 53. An inner wall of the rotatable sleeve 15 has a locking groove 154 radially recessed outwardly and engaged with the locking projection 532 to lock the fixing assembly 1 and the mounting base 5 together.

Figure 8:
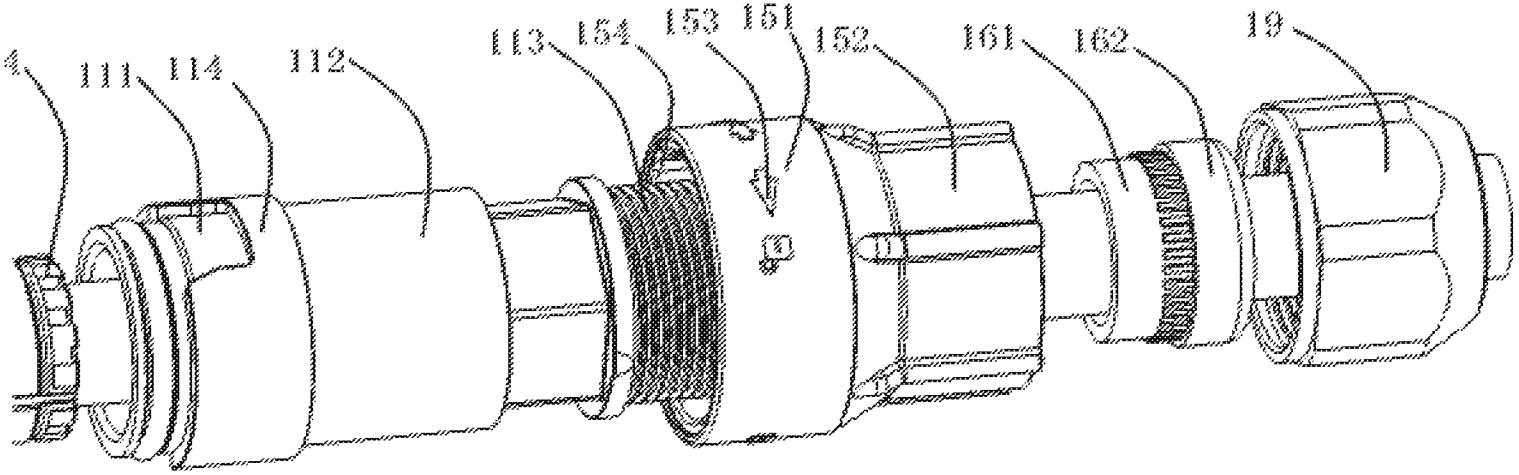
FIG. 8 is a detail view of a portion C of FIG. 6.
Figure 9:
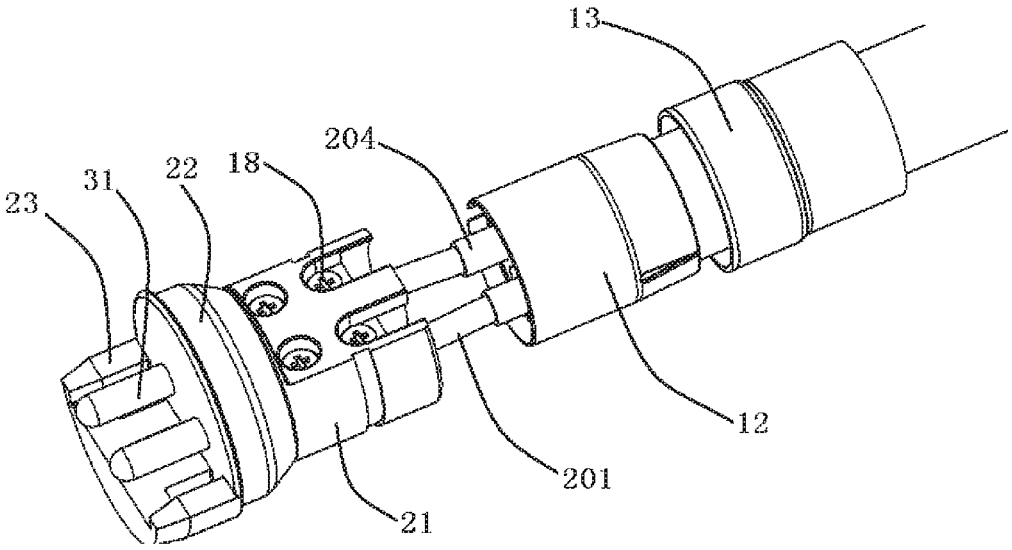
FIG. 9 is a perspective view of a connection of a conductive terminal with a conductor of a cable.
Figure 10:
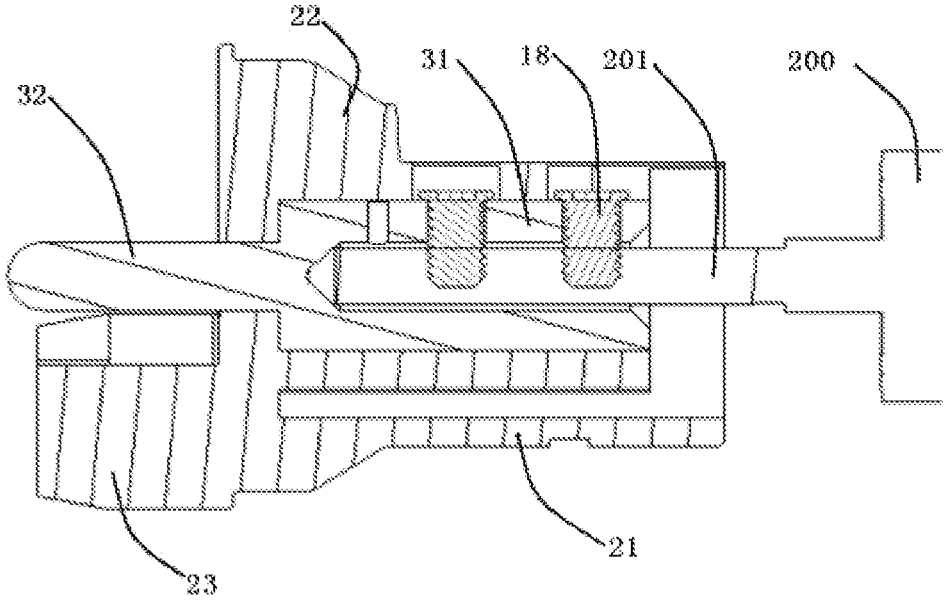
FIG. 10 is a sectional side view of the connector of FIG. 9.

In an exemplary embodiment, each of the locking protrusion 531 and the locking groove 154 has a substantially L-shape mated with each other to allow the fixing assembly 1 to be locked with or separated from the mounting base 5 by rotating the rotatable sleeve 15 relative to the mounting base 5. For ease of operation, the rotatable sleeve 15 is provided with an indicator 153 indicating ON or OFF, as shown in FIG. 8. Typically, the mounting base 5 is mounted on a mounting panel or mounting bracket of an electrical apparatus by the flange 51.

As shown in FIGS. 2, 5 and 8, the electrical connector 100 further comprises a third shielding sleeve 19 threaded to the second end of the main cylinder 11, through which the electrical cable 200 passes to be inserted into the receiving portion 17 of the main cylinder 11.

The electrical connector 100, as shown in FIGS. 2, 5, and 8, comprises a sealing sleeve 16 sleeved over the cable 200 and including a first portion 161 having a small diameter and adapted to be inserted into the first end of the receiving portion 17, and a second portion 162 having a large diameter and adapted to remain outside the first end of the receiving portion 17 and to be pressed between the first end of the main cylinder 11 and an end of the third shielding sleeve 19 so as to seal the first end of the receiving portion 17.

In an embodiment, as shown in FIG. 2, the third shielding sleeve 19 has a conical inner wall surface 191 tapering outwardly and adapted to press the second portion 162 of the sealing sleeve 16 against the outer sheath 202 of the cable 200, thereby further improving the sealing effect.

The first, second, and third shielding sleeves 4, 13 and 19 described above may be made of a material such as copper, stainless steel or the like. The cable 200 may have a circular or a rectangular cross-section.

It should be appreciated by those skilled in this art that the above embodiments are intended to be illustrative, and many modifications may be made to the above embodiments by those skilled in this art, and various structures described in various embodiments may be freely combined with each other without conflicting in configuration or principle. Although the disclosure have been described hereinbefore in detail with reference to the attached drawings, it should be appreciated that the disclosed embodiments in the attached drawings are intended to illustrate the preferred embodiments of the disclosure by way of example, and should not be construed as limitation to the disclosure. Although a few embodiments of the general inventive concept of the disclosure have been shown and described, it would be appreciated by those skilled in the art that changes or modification may be made to these embodiments without departing from the principles and spirit of the general inventive concept, the scope of which is defined in claims and their equivalents.

What is claimed is:

1. An electrical connector adapted to be electrically connected with a cable, comprising:

a fixing assembly including a main cylinder in which a receiving portion extending in an axial direction of the electrical connector is formed, an end of the cable is inserted into the receiving portion from a first end of the receiving portion;

an insulation body extending from a second end of the receiving portion;

a conductive terminal overmolded in the insulation body and including a mounting portion mounted in the insulation body and a contact portion extending out of the insulation body, the mounting portion is electrically connected with a conductor of the cable by a bolt member, the insulation body including a keyed portion extending substantially parallel and laterally adjacent to the contact portion for preventing the contact portion from being improperly inserted into a mating terminal of a mating connectors;

a first shielding sleeve extending from the second end of the receiving portion and sleeved over the insulation body;

a second shielding sleeve sleeved over a portion of the conductor of the cable, the first shielding sleeve extending to a portion of the second shielding sleeve from the insulation body;

a third shielding sleeve threaded to a second end of the main cylinder, through which the cable passes to be inserted into the main cylinder; and a sealing sleeve sleeved over the cable, the sealing sleeve including a first portion having a first diameter and inserted into the first end of the receiving portion and a second portion having a second diameter larger than the first diameter and remaining outside the first end of the receiving portion, the second portion pressed between the first end of the main cylinder and an end of the third shielding sleeve so as to seal the first end of the receiving portion.

2. The electrical connector of claim 1, wherein the mounting portion is a cylindrical structure extending axially, a side wall of the cylindrical structure has a through hole extending transversely through which the bolt member passes to abut against the conductor within the cylindrical structure.

3. The electrical connector of claim 1, wherein the insulation body includes an insertion portion inserted into the receiving portion at the second end of the receiving portion and an extension integrally connected with the insertion portion and located outside the receiving portion.

4. The electrical connector of claim 3, wherein the keyed portion extends from the extension in a direction of extension of the contact portion.

5. The electrical connector of claim 1, further comprising a first shielding sleeve extending from the second end of the receiving portion and sleeved over the insulation body.

6. The electrical connector of claim 5, wherein an end of the first shielding sleeve extending from the second end of the receiving portion has a plurality of resilient pieces folded onto the end the first shielding sleeve.

7. The electrical connector of claim 1, wherein the fixing assembly includes a main cylinder in which the receiving portion is formed.

8. The electrical connector of claim 7, wherein the fixing assembly includes a sealing ring mounted in a groove formed in an exterior surface of a first end of the main cylinder.

9. The electrical connector of claim 7, wherein the fixing assembly includes a rotatable sleeve rotatably disposed over the main cylinder.

10. An electrical connector adapted to be electrically connected with a cable, comprising:

a fixing assembly including a main cylinder in which a receiving portion is formed and a rotatable sleeve rotatably disposed over the main cylinder, the receiving portion extending in an axial direction of the electrical connector, an end of the cable is inserted into the receiving portion from a first end of the receiving portion;

an insulation body extending from a second end of the receiving portion;

a conductive terminal overmolded in the insulation body and including a mounting portion mounted in the insulation body and a contact portion extending out of the insulation body, the mounting portion is electrically connected with a conductor of the cable by a bolt member; and a mounting base mounted on and selectively lockable with the rotatable sleeve, the mounting base including a flange having a mounting hole, a receiving sleeve for receiving a portion of the fixing assembly and a locking member engaged with a mating locking member formed on the rotatable sleeve.

11. The electrical connector of claim 10, further comprising:

a first shielding sleeve extending from the second end of the receiving portion and sleeved over the insulation body;

an elastic sleeve received in the main cylinder and sleeved over a portion of the cable; and a second shielding sleeve sleeved over a portion of the conductor of the cable and a portion of the elastic sleeve, the first shielding sleeve extending to a portion of the second shielding sleeve from the insulation body.

12. The electrical connector of claim 11, further comprising a third shielding sleeve threaded to a second end of the main cylinder, through which the cable passes to be inserted into the main cylinder.

13. The electrical connector of claim 12, further comprising a sealing sleeve sleeved over the cable, the sealing sleeve including a first portion having a first diameter and inserted into the first end of the receiving portion and a second portion having a second diameter larger than the first diameter and remaining outside the first end of the receiving portion, the second portion pressed between the first end of the main cylinder and an end of the third shielding sleeve so as to seal the first end of the receiving portion.

14. The electrical connector of claim 13, wherein the third shielding sleeve has a conical inner wall surface tapering outwardly and pressing the second portion of the sealing sleeve against an outer sheath of the cable.

15. The electrical connector of claim 10, wherein the flange includes a plurality of mounting holes.

16. The electrical connector of claim 15, wherein the locking member includes an axial protrusion axially protruding from the receiving sleeve and a locking protrusion radially protruding outwardly outside the axial protrusion.

17. The electrical connector of claim 16, wherein a receiving groove radially recessed inwardly is formed outside of a first end of the main cylinder to receive the axial protrusion of the locking member, and an inner wall of the rotatable sleeve has a locking groove radially recessed outwardly and engaged with the locking projection to lock the fixing assembly and the mounting base together.

18. The electrical connector of claim 17, wherein each of the locking protrusion and the locking groove has a substantially L-shape mated with each other to allow the fixing assembly to be locked with or separated from the mounting base by rotating the rotatable sleeve relative to the mounting base.

19. An electrical connector adapted to be electrically connected with a cable, comprising:

a fixing assembly including a main cylinder in which a receiving portion is formed and a rotatable sleeve rotatably disposed over the main cylinder, the receiving portion extending in an axial direction of the electrical connector, an end of the cable is inserted into the receiving portion from a first end of the receiving portion;

an insulation body extending from a second end of the receiving portion;

a first shielding sleeve extending from the second end of the receiving portion and sleeved over the insulation body;

a second shielding sleeve sleeved over a portion of a conductor of the cable and a portion of an outer sheath of the cable, the first shielding sleeve extending to a portion of the second shielding sleeve from the insulation body;

a third shielding sleeve threaded to a second end of the main cylinder, through which the cable passes to be inserted into the main cylinder; and a conductive terminal overmolded in the insulation body and including a mounting portion mounted in the insulation body and a contact portion extending out of the insulation body, the mounting portion electrically connected with a conductor of the cable.

20. The electrical connector of claim 19, wherein the fixing assembly includes an elastic sleeve received in the main cylinder and sleeved over a portion of an exposed braided shielding wire that is folded back onto the outer sheath of the cable, the elastic sleeve pressing the folded braided shielding wire against the outer sheath of the cable.

* * * * *